US010694908B2

(12) United States Patent
Yan

(10) Patent No.: US 10,694,908 B2
(45) Date of Patent: Jun. 30, 2020

(54) JET CLEANING STRUCTURE OF THE CLEANING ROBOT

(71) Applicant: Jason Yan, New Taipei (TW)

(72) Inventor: Jason Yan, New Taipei (TW)

( * ) Notice: Subject to any disclaimer, the term of this patent is extended or adjusted under 35 U.S.C. 154(b) by 127 days.

(21) Appl. No.: 15/936,717

(22) Filed: Mar. 27, 2018

(65) Prior Publication Data

US 2019/0038093 A1 Feb. 7, 2019

(30) Foreign Application Priority Data

Aug. 7, 2017 (TW) ..... 106126515 A

(51) Int. Cl.

| | |
|---|---|
| ***A47L 5/14*** | (2006.01) |
| ***A47L 7/02*** | (2006.01) |
| ***A47L 11/40*** | (2006.01) |
| ***A47L 11/32*** | (2006.01) |

(52) U.S. Cl.

CPC ..... *A47L 5/14* (2013.01); *A47L 7/02* (2013.01); *A47L 11/32* (2013.01); *A47L 11/4041* (2013.01); *A47L 2201/00* (2013.01)

(58) Field of Classification Search

CPC ..... A47L 5/14; A47L 11/32; A47L 11/4041; A47L 7/02; A47L 2201/00; A47L 9/0488; A47L 9/0477; A46B 2200/3033; A46B 13/006

USPC ..... 15/319, 345

See application file for complete search history.

(56) References Cited

U.S. PATENT DOCUMENTS

| | | | | |
|---|---|---|---|---|
| 8,966,707 | B2 * | 3/2015 | Morse | A47L 5/14 15/319 |
| 2003/0192144 | A1 * | 10/2003 | Song | A47L 5/14 15/346 |
| 2008/0092324 | A1 * | 4/2008 | Liao | A47L 5/14 15/319 |
| 2019/0053678 | A1 * | 2/2019 | Yan | A47L 9/0488 |

* cited by examiner

*Primary Examiner* — David Redding
(74) *Attorney, Agent, or Firm* — WPAT, PC

(57) ABSTRACT

A jet cleaning structure of a cleaning robot mainly comprising at least one jet port and one roller brush, wherein the jet port is disposed at a perimeter of a suction port at the bottom of the cleaning robot and is provided for ejecting air towards the underside of the suction port; the roller brush includes a shaft and a plurality of hard brush rods, wherein two ends of the shaft are disposed in a roller groove at the bottom of the cleaning robot, the plurality of hard brush rods is arranged in a straight or helical manner in equal parts on the shaft, when the cleaning robot is moving, the cleaning robot drives the shaft to rotate with respect to the moving direction of the cleaning robot so that the cleaning robot can use the plurality of hard brush rods to push away the fluff of the carpet and use the jet port to eject air to blow away the dust and foreign substance accumulated at the bottom of the fluff, thereby allowing the suction port disposed at the bottom of the cleaning robot to suck in the dust and foreign substance accumulated at the bottom of the fluff to the dust box and to effectively clean the carpet.

7 Claims, 3 Drawing Sheets

JET CLEANING STRUCTURE OF THE CLEANING ROBOT

FIELD OF THE INVENTION

The present invention relates to a cleaning robot, and more particularly to a jet cleaning structure of the cleaning robot which can push away the fluff of a carpet and suck the dust and foreign substances stuck in the carpet into the cleaning robot.

BACKGROUND OF THE INVENTION

With the progress of modern technologies, there have been widespread applications of automation equipment. In order to help people save time and effort needed for house cleaning, cleaning robots are provided currently on the market for automatic ground cleaning. This kind of cleaning robot can roam automatically in the house and use brushes (including side brushes and roller brushes) at the bottom of the cleaning robot to collect dust and foreign substances and then have the dust and foreign substances sucked into the dust box of the cleaning robot, thereby achieving the purpose of automatic ground cleaning.

This kind of cleaning robot uses side brushes and roller brushes having bristles of relatively soft materials, so that when the side brushes and roller brushes rotate and collect dust, the soft bristles can help increase the contact area with the ground, making it more efficient to collect dust and foreign substances. However, when the cleaning robot moves on the carpet, it is difficult for bristles to push away the fluff since they are too soft, so that the cleaning robot can only sweep the surface of the carpet and fails to clean the dust and foreign substances accumulated at the bottom of the fluff, resulting in low carpet-cleaning efficiency.

Therefore, the cleaning brushes used for the aforesaid traditional cleaning robot still have many deficiencies to be overcome.

In view of the above-described deficiencies of the traditional cleaning robot, after years of constant effort in research, the inventor of this invention has consequently developed and proposed a jet cleaning structure of a cleaning robot in the present invention.

SUMMARY OF THE INVENTION

In order to solve the problems described above, it is an object of the present invention to provide a jet cleaning structure of a cleaning robot which can push away the fluff of a carpet and suck the dust and foreign substances stuck in the carpet into the dust box of the cleaning robot.

In order to achieve the above object, a jet cleaning structure of a cleaning robot mainly comprises at least one jet port and one roller brush, wherein the at least one jet port is disposed around the periphery of a suction port located at the bottom of the cleaning robot and is provided for ejecting air towards the underside of the suction port while running the cleaning robot. The roller brush includes a shaft and a plurality of hard brush rods, wherein the shaft is set in a roller groove at the bottom of the cleaning robot. Two ends of the shaft are pivoted in two connecting structures respectively located at each end of the roller groove. The plurality of hard brush rods are equally arranged on the shaft in a straight or helical manner.

When the cleaning robot is moving, the jet cleaning structure of the cleaning robot drives the shaft to rotate with respect to the moving direction of the cleaning robot so that the cleaning robot can use the plurality of hard brush rods to push away the fluff of the carpet and use the jet port to eject air to raise the dust and foreign substance accumulated at the bottom of the fluff, thereby allowing the suction port disposed at the bottom of the cleaning robot to suck the dust and foreign substance accumulated at the bottom of the fluff into the dust box to effectively achieve the purpose of cleaning the carpet.

DETAILED DESCRIPTION OF THE PREFERRED EMBODIMENT

The present invention is exemplified by the following embodiment; however, the invention is not limited thereto.

Figure 1:
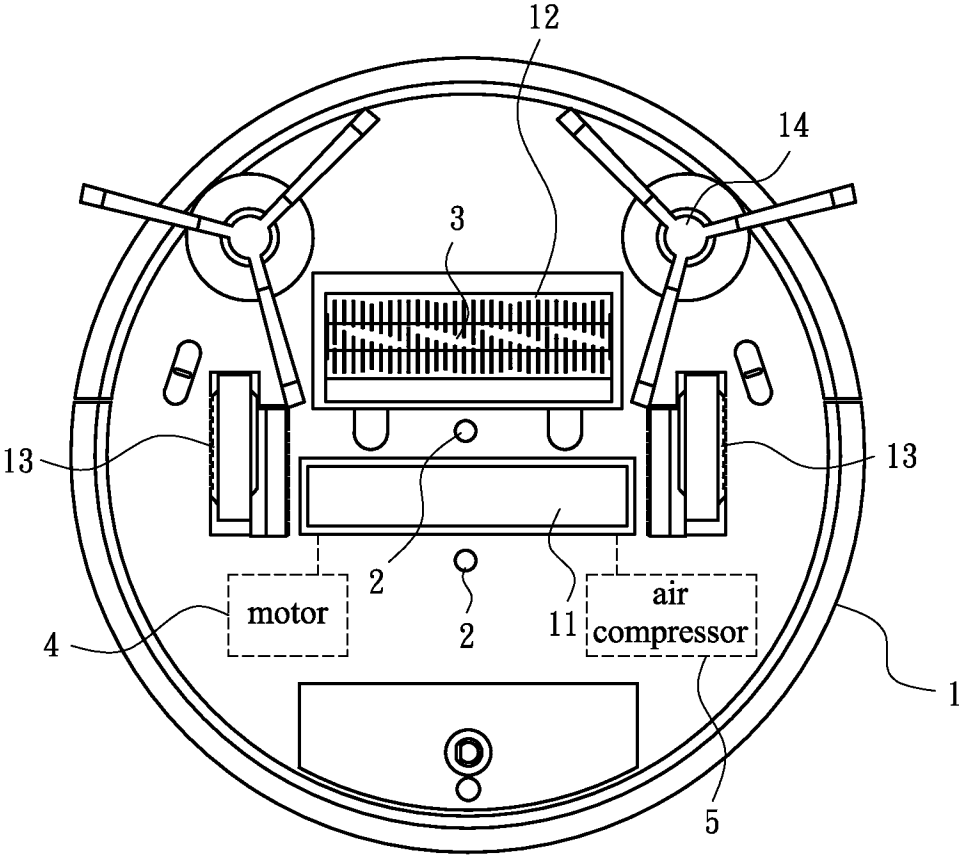
FIG. 1 is a schematic view of a jet cleaning structure of a cleaning robot of the present invention.
Figure 2:
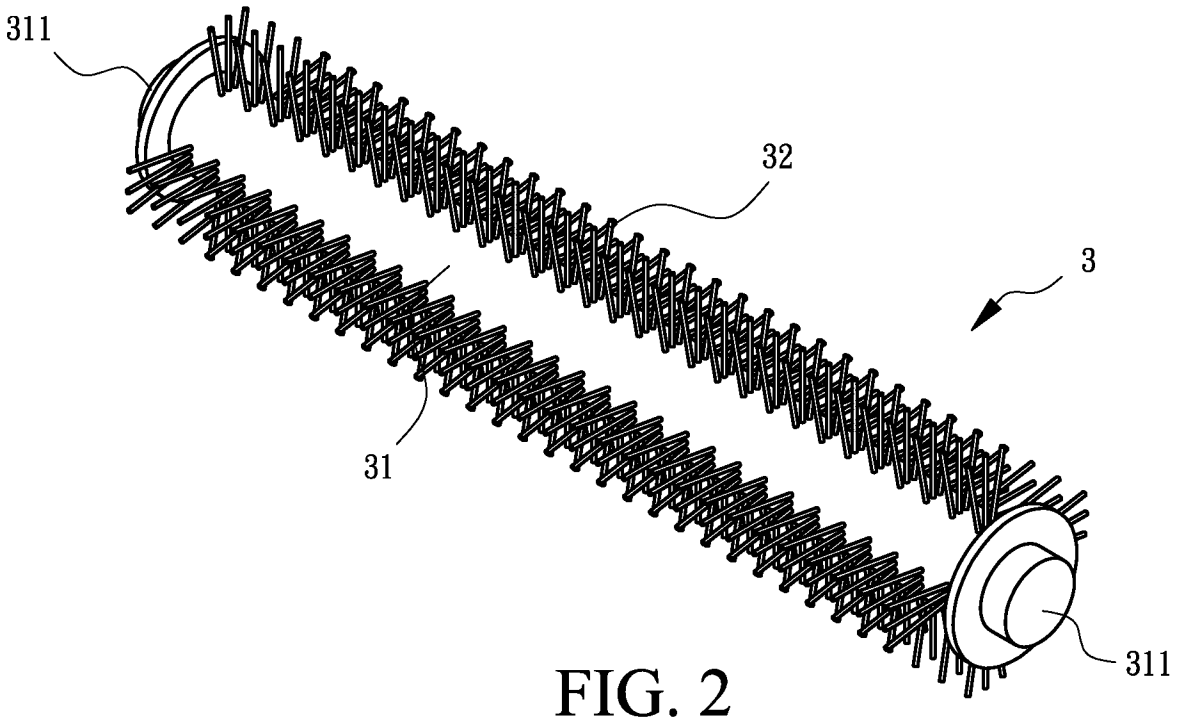
FIG. 2 is a perspective view of a first kind of a roller brush of the jet cleaning structure of the cleaning robot.
Figure 3:
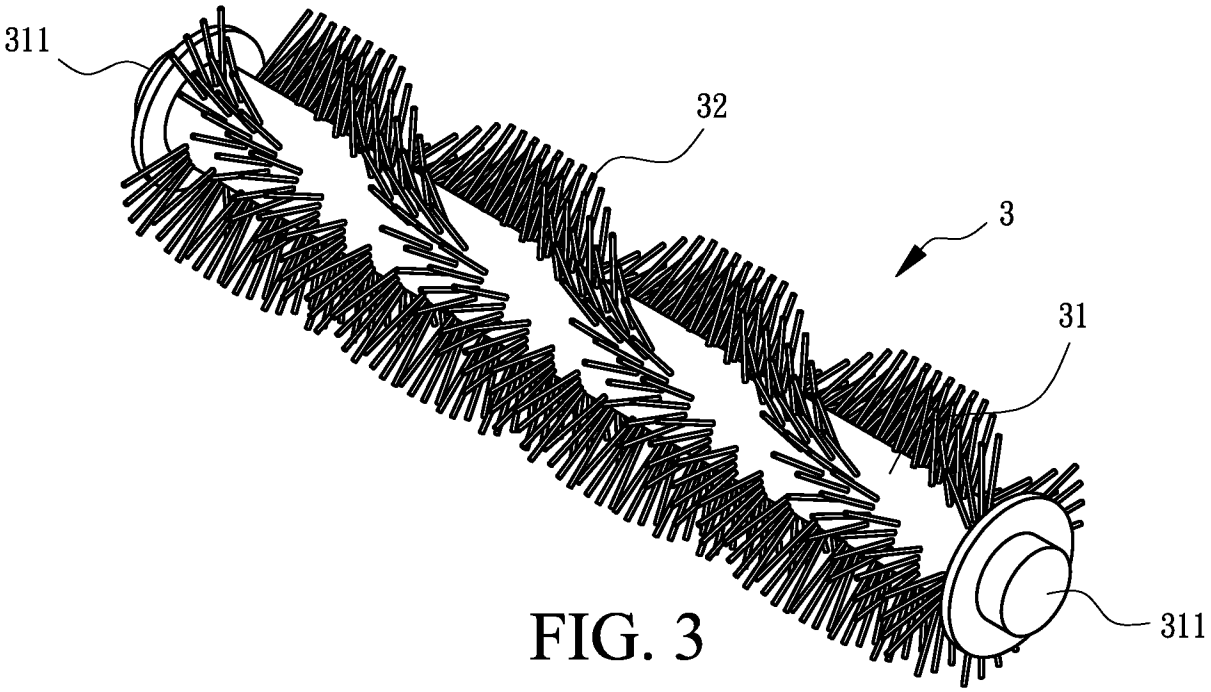
FIG. 3 is a perspective view of a second kind of a roller brush of the jet cleaning structure of the cleaning robot.

Please refer to FIGS. 1-3, a jet cleaning structure of a cleaning robot 1 of the present invention mainly comprises at least one jet port 2 disposed around the periphery of a suction port 11 located at the bottom of the cleaning robot 1, and a roller brush 3 is disposed in a roller groove 12 so that the roller brush faces the suction port 11 and heads towards the moving direction of the cleaning robot 1, wherein the cleaning robot 1 is disposed with a motor 4 therein, the motor 4 is connected with the suction port 11 and generates a negative pressure by rotating to create a suction force at the suction port 11, the jet port 2 is connected with the motor 4 to eject the air sucked into the cleaning robot 1 through the suction port 11, or the jet port 2 is connected with an air compressor 5 to eject the air compressed by the air compressor 5.

The roller brush 3 mainly comprises a shaft 31 and a plurality of hard brush rods 32, wherein the shaft 31 is set in a roller groove 12 at the bottom of the cleaning robot 1. Two ends of the shaft 31 are pivoted in two connecting structures 311 respectively located at each end of the roller groove 12. The plurality of hard brush rods 32 are equally arranged on the shaft in a straight or helical manner, wherein the plurality of hard brush rods 32 are made of plastic or rubber materials.

When using the jet cleaning structure of the cleaning robot 1, the cleaning robot 1 is first placed on the floor, then the cleaning robot 1 is activated and is moved by wheels 13 at the bottom of the cleaning robot 1, while the side brushes 14 of the cleaning robot 1 rotate to drive the roller brush 3 to rotate with respect to the moving direction of the cleaning robot 1. When the cleaning robot 1 is moving, the side brushes 14 of the cleaning robot 1 collect the dust and foreign substances along the moving path of the cleaning robot 1 and move them to the underside of the cleaning robot 1, then the jet port 2 ejects air to the underside of the suction port 11 to raise the dust and foreign substances gathered below the suction port 11, and the plurality of hard brush rods 32 driven by the shaft 31 sweep the dust and foreign substances on the floor, so that the suction port 11 can suck the dust and foreign substances raised by the jet port 2 into the dust box (not shown) of the cleaning robot 1, thereby preventing the dust and foreign substances from being stuck on the floor by static charges and cannot be collected in the dust box via the suction port 11.

While the cleaning robot 1 moving onto the carpet, the side brushes 14 of the cleaning robot 1 collect the dust and foreign substances along the moving path of the cleaning robot 1 and sweep them to the underside of the cleaning robot 1, and the shaft 31 drives the plurality of hard brush rods 32 to rotate with respect to the moving direction of the cleaning robot 1 and to push away the fluff of the carpet, then the jet port 2 ejects the air to raise the dust and foreign substances accumulated at the bottom of the fluff, and then the suction port 11 disposed in the cleaning robot 1 sucks the dust and foreign substances accumulated at the bottom of the fluff into the dust box, thereby cleaning the carpet effectively.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A jet cleaning structure of a cleaning robot comprising:

a motor disposed in the cleaning robot;

a suction port disposed at a bottom of the cleaning robot in connection with the motor;

a first jet port and a second jet port located at the bottom of the cleaning robot and disposed at both sides of the suction port, wherein the first jet port and the second jet port eject air underside of the suction port for raising dust below the suction port; and a roller brush, disposed adjacent to the suction port and located at the bottom of the cleaning robot, comprising a shaft and a plurality of hard brush rods, wherein the roller brush heads towards the moving direction of the cleaning robot, and the plurality of hard brush rods are equally arranged on the shaft.

2. The jet cleaning structure of the cleaning robot as claimed in claim 1, wherein the plurality of hard brush rods are equally arranged on the shaft in a straight or helical manner.

3. The jet cleaning structure of the cleaning robot as claimed in claim 1, wherein the plurality of hard brush rods are made of plastic or rubber materials.

4. The jet cleaning structure of the cleaning robot as claimed in claim 1, wherein the jet cleaning structure further includes two connecting structures respectively disposed at each end of the shaft to allow the shaft to be pivoted therebetween.

5. The jet cleaning structure of the cleaning robot as claimed in claim 1, wherein the roller brush rotates with respect to the moving direction of the cleaning robot.

6. The jet cleaning structure of the cleaning robot as claimed in claim 1, wherein the at least one jet port is connected with and driven by the motor to eject the air sucked into the cleaning robot through the suction port.

7. The jet cleaning structure of the cleaning robot as claimed in claim 1, wherein the jet port is connected with an air compressor disposed within the cleaning robot to eject air compressed by the air compressor.

* * * * *